United States Patent [19]

Hasegawa et al.

[11] Patent Number: 5,026,186

[45] Date of Patent: Jun. 25, 1991

[54] VIBRATING APPARATUS INCLUDING MEANS FOR ABSORBING VIBRATION AND FOR LOCKING VIBRATING UNIT AGAINST MOVEMENT

[75] Inventors: Kazumi Hasegawa; Takashi Moriya; Hiromi Hibino; Akira Takamura, all of Tokyo, Japan

[73] Assignee: Citizen Watch Co., Ltd., Tokyo, Japan

[21] Appl. No.: 378,288

[22] Filed: Jul. 11, 1989

[30] Foreign Application Priority Data

Jul. 12, 1988 [JP] Japan ..... 63-91489
Jul. 20, 1988 [JP] Japan ..... 63-179269

[51] Int. Cl.[5] ..... B41J 29/04

[52] U.S. Cl. ..... 400/691; 400/693; 400/663; 400/668

[58] Field of Search ..... 400/663, 668, 674, 691, 400/693, 694, 689, 323, 121; 101/93.04, 93.05; 248/561, 581, 589, 610, 638; 267/136, 137

[56] References Cited

U.S. PATENT DOCUMENTS

| | | | |
|---|---|---|---|
| 2,923,505 | 2/1960 | Immendorf | 248/561 |
| 4,227,455 | 10/1980 | Pennebaker | 101/93.09 |
| 4,306,497 | 12/1981 | Hamada | 101/93.05 |
| 4,325,133 | 4/1982 | Reitmayer | 248/638 |
| 4,543,884 | 10/1985 | Kikuchi et al. | 101/93.05 |
| 4,713,714 | 12/1987 | Gatti et al. | 248/581 |
| 4,796,849 | 1/1989 | Fouassier | 267/136 |
| 4,863,139 | 9/1989 | Grutzmacher et al. | 248/638 |

FOREIGN PATENT DOCUMENTS

| | | | |
|---|---|---|---|
| 1176391 | 8/1964 | Fed. Rep. of Germany | 248/561 |
| 93166 | 6/1982 | Japan | 400/124 |
| 64366 | 8/1984 | Japan | 101/93.05 |
| 154975 | 7/1986 | Japan | 400/674 |

OTHER PUBLICATIONS

IBM Technical Disclosure Bulletin, "Anti-Vibration Mount Locking Device", Dunman, J. P. and Parrish, B. H., vol. 20, No. 11A, Apr. 1978.

*Primary Examiner*—Edgar S. Burr
*Assistant Examiner*—Joseph R. Keating
*Attorney, Agent, or Firm*—Wenderoth, Lind & Ponack

[57] ABSTRACT

A vibrating apparatus, such as a shuttle type dot printer, has a vibrating unit mounted in the casing thereof and which, when it operates, generates vibrations in opposite lateral directions of the vibrating unit. The vibrating unit is mounted in the casing for providing interacting of vibrations which occur in the inside by leaf type springs connected between pairs of projections on the vibrating unit and the casing with the plane of the leaf type springs perpendicular to the lateral direction of the vibrations of the vibrating unit. The apparatus further has a locking device for locking the vibrating unit relative to the casing, which, when the casing is on a supporting surface, allows the vibrating unit to vibrate freely in the opposite lateral directions, and which, when the casing is lifted off the supporting surface, locks the vibrating unit to the casing.

6 Claims, 6 Drawing Sheets

VIBRATING APPARATUS INCLUDING MEANS FOR ABSORBING VIBRATION AND FOR LOCKING VIBRATING UNIT AGAINST MOVEMENT

The present invention relates to an apparatus which vibrates, such as a shuttle type dot printer, and which apparatus has means to absorb or damp the vibration thereof. The invention further relates to such an apparatus which has means to lock a vibrating unit of the apparatus relative to the casing thereof so that the apparatus can be transported without damage to the vibrating unit.

BACKGROUND OF THE INVENTION

A conventional apparatus for absorbing or damping vibration of a printer, such as a shuttle type dot printer, is disclosed in Japanese Laid-Open Patent Application No. SHO 56-18442.

The print mechanism unit of this printing apparatus is supported on a base of the casing or housing thereof through a vibration absorbing material made, for example, of rubber.

This conventional apparatus has a defect that absorption or damping of the vibration of the unit is insufficient.

Such a conventional print mechanism unit has a print head which moves reciprocatingly in the right and left directions and makes the print mechanism unit a vibrating unit of the apparatus. The vibration absorbing material which supports the print mechanism unit in the casing or housing partially absorbs the vibration caused by this motion.

Moreover, a straight movement of the print mechanism unit in the left and right direction of the print mechanism unit caused by this movement of the print head, produces a component of force in the up and down direction. Further, the vibration absorbing material also moves in a very small circular motion during such vibration.

The weight of the print mechanism unit, the circular movement thereof and the up and down component caused by the vibrations of the print mechanism unit cause vibrations to be transferred to the housing through the same vibration absorbing material, and this in turn causes noise to occur.

To avoid this problem, the conventional vibration absorbing material provides high elasticity, i.e. a high resistance to deformation, in the up and down direction for increasing the stability in this direction.

However, to absorb the vibration caused by the movements of the print head, it is desirable to reduce the resisting force in the right and left directions which is provided by the vibration absorbing material, which is normally in the form of four rubber bodies, such as four feet supporting the print mechanism unit on the housing. To satisfy this requirement, the elasticity of the vibration absorbing material in the right and left directions should be made lower.

However, if the elasticity in the right and left directions of the vibration absorbing material is made lower, the elasticity in the up and down directions is also made lower at the same time, and this is the opposite effect to that which is desired for the best support of the print mechanism unit in the up and down directions, i.e. high elasticity so as to reduce support for the vibrating unit of the apparatus on the base of the housing.

It is not possible to reduce the elasticity of the vibration absorbing material in the right and left directions only, and at the same time either maintain the elasticity in the up and down directions or even increase it where the print mechanism unit is supported by the four rubber elastic bodies.

Therefore, the vibration absorbing material cannot provide a good effect both for providing stable support for the vibrating unit of the printing device on the base of the housing and at the same time absorbing the lateral vibration in the opposite lateral directions.

Further, it is the normal practice with machines which have a vibrating unit which moves relative to the base, such as the print mechanism unit of the shuttle type dot printer, to lock the vibrating unit relative to the casing of the machine when it is necessary to transport the machine. A conventional means for doing this is to provide a threaded hole in the vibrating unit of the machine and an unthreaded hole in the casing or housing, and to provide a bolt which is inserted through the unthreaded hole and threaded into the vibrating unit so as to lock the vibrating unit to the casing. When the machine reaches its desired location, the bolt is removed, and the machine placed on a desk, floor, or other supporting surface. The thus removed bolt, however, is then separate from the housing, and very frequently is misplaced, so that when it is desired to move the machine again, another bolt must be located.

OBJECTS AND BRIEF SUMMARY OF THE INVENTION

The first object of the present invention is to provide means for mounting the vibrating unit of the vibrating apparatus on the casing so as to provide increased absorption or damping of vibration, while at the same time providing stable support in the vertical direction with high elasticity.

It is a second object of the invention to provide means for automatically locking the vibrating unit of the apparatus in position relative to the casing when the casing is lifted off a supporting surface, and which, when the casing is again placed on a supporting surface, frees the vibrating unit of the apparatus for vibration movement relative to the casing.

These objects are achieved by an apparatus comprising a casing for said apparatus, a vibrating unit of said apparatus for being mounted in said casing and having opposite lateral end walls, and which, when it operates, generates vibrations in opposite lateral directions of said vibrating unit toward said lateral end walls as well as vibrations in the up and down direction of said apparatus, means for mounting said vibrating unit on said casing for providing increased absorption of vibration, said means including at least one projection on each of said end walls and at least one further projection on a wall of the casing opposed to the lateral end wall and spaced in the up and down direction from said at least one projection, and a leaf type spring connected between each pair of said projections with the plane of said leaf type spring perpendicular to the lateral direction of the vibrations of said vibrating unit.

There are preferably two pairs of projections on each end wall of said vibrating unit and two leaf type springs at each end of said vibrating unit.

The apparatus can further have a locking means for locking said vibrating unit relative to said casing, said locking means having a locking member on said vibrating unit, a lock arm corresponding to said locking member and pivotally mounted on said casing and pivotable into and out of locking engagement with the corresponding locking member, spring means engaged with each lock arm urging said lock arm into locking engagement with the locking member, said lock arm having an arm portion extending therefrom with a free end, and a pressing member corresponding to said lock arm and extending through said casing and having the end thereof within said casing in engagement with the free end of the corresponding lock arm and having the other end projecting out of the casing a distance sufficient for, when the casing is placed on a supporting surface, urging the corresponding lock arm out of locking engagement with said locking member and when the casing is lifted off the supporting surface, the corresponding spring means urges said lock arm into locking engagement with said locking member and the corresponding pressing member is urged out of the casing by said arm portion of the lock arm.

BRIEF DESCRIPTION OF THE DRAWINGS

The present invention will now be described more fully with reference to the accompanying drawings, in which.

DETAILED DESCRIPTION OF THE INVENTION

Figure 1:
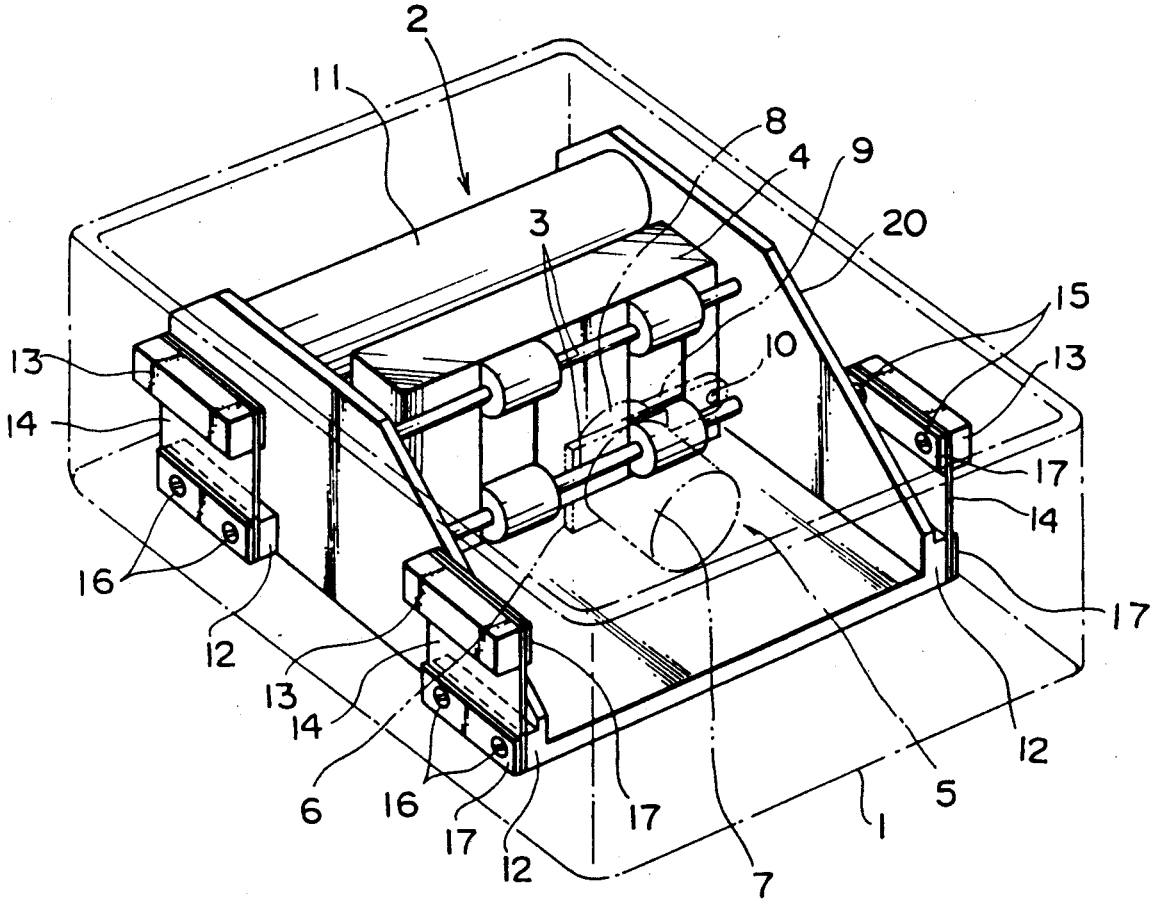
FIG. 1 is a perspective view, with some parts in phantom lines, of a printer having a vibration absorbing mounting means according to a preferred embodiment of the present invention.

As shown in FIG. 1, a casing or housing 1 is provided for holding a vibrating unit, such as a print mechanism unit of a shuttle type dot printer. A print mechanism unit 2 is provided which has a print head 4, and means for moving the print head 4 and a platen 11.

A frame 20 is provided for the print mechanism unit 2 in opposite lateral end walls, and supports both ends of guide shafts 3 which are mounted parallel to each other.

The print head 4 is slidably supported on the guide shafts 3 for sliding movement in the right and left directions. The print head 4 is moved reciprocally and continuously by means of a print head moving means 5 mounted on the frame 20. This print head moving means 5 has a motor 7 which is mounted on a motor mounting plate 6 fixed on the frame 20, a flywheel 8 mounted on a rotating shaft of the motor 7, a connecting rod 9 which has one end eccentrically rotatably connected to the flywheel 8 and the other end 10 is rotatably connected to the print head 4.

The platen 11 is positioned in front of the print head 4.

On lower portions of both sides of the frame 20 are provided projections 12 for mounting the print mechanism unit 2, which forms the vibrating unit of the apparatus and is constituted by the print head, motor, platen and frame, on the casing or housing 1 of the apparatus. There are two projections 12 on each side of the frame spaced longitudinally from each other.

On upper portions of each side of the housing 1 are two projections 13 at positions corresponding to but above the projections 12 on the frame 20.

Figure 2:
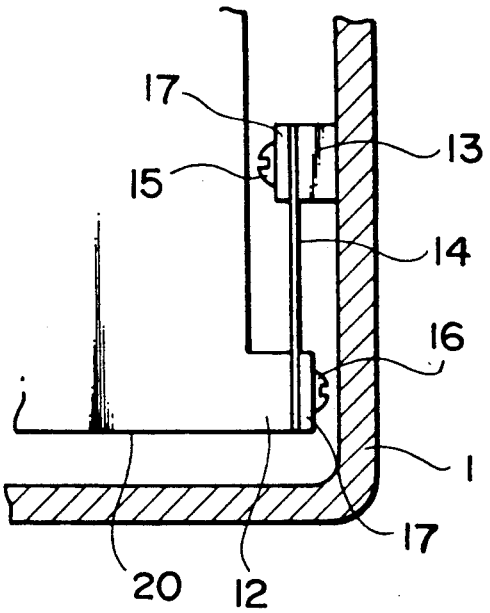
FIG. 2 is a sectional view of the mounting means of FIG. 1.

A flat leaf type spring 14 made of spring steel and generally rectangular in shape is connected between each pair of corresponding projections. The spring 14 is shown in FIG. 2, and is fixed at the upper end to the corresponding projection 13 by pressing plates 17 and by screws 16 and at the lower end to the projection 12 by pressing plates 17 and screws 16 so as to have the plane of the leaf spring 14 perpendicular to the lateral direction of reciprocating motions of the print head 4.

Therefore, the print mechanism unit 2 which forms the vibrating unit of the apparatus is suspended on the housing 1 by four leaf type springs having low stiffness in the right and left directions, i.e. the direction of movement of the print head 4.

In place of the spring steel leaf type spring 14, a plastic leaf type spring having low stiffness may be used. The plastic can be an industrial plastic, such as synthetic resin.

If the plastic leaf type spring is used, it is unable to be used as a path for guiding static electricity from the print mechanism unit 2 to ground. Otherwise, a plastic spring is the equivalent of a metal leaf type spring.

In operation, when the motor 7 of the print head moving means 5 is rotated, the rotation is transferred to the flywheel 8 on the rotating shaft, and the connecting rod 9 having the one end eccentrically rotatably mounted on the flywheel 8 is reciprocated in right and left directions while swinging up and down.

By these motions, the print head 4 to which the other end of the connecting rod is connected is guided and reciprocated along the two guide shafts 3.

When the print head 4 is reciprocated, it prints on paper which is put in the platen 11.

During printing, continuous reciprocating of the print head 4 produces vibrations of the print mechanism unit 2 of the apparatus in the right and left directions caused by inertia of the print head 4. But because the print mechanism unit 2 is supported on the leaf springs 14 which flex in the direction of the vibrations, the vibrations are substantially absorbed.

By making the elasticity (spring constant) of the leaf type springs 14 very low, the vibrations can be effectively absorbed or damped by these four springs 14.

Therefore, the transmission of this type of vibration to the casing can be prevented effectively.

However, the elasticity in the up and down directions of the springs 14 is high. Therefore, the support of the print mechanism unit 2 in the vertical direction is stable.

Figure 3:
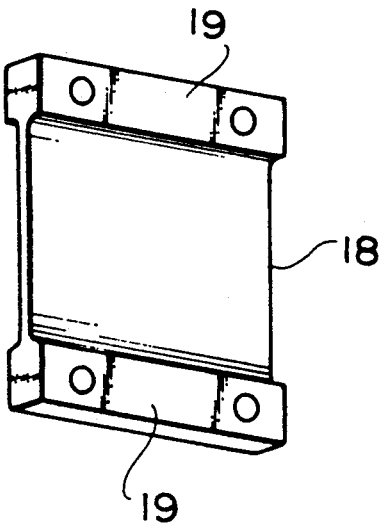
FIG. 3 is a perspective view of an essential part of the mounting means of FIG. 2.

Another example of the leaf type spring is shown in FIG. 3. The leaf spring 18 has projections 19 integrally formed at the portions which engage projections 12 on the print mechanism unit 2 and projections 13 on the casing 1. Therefore, this spring 18 does not need the separate pressing plates 17, so that the number of parts can be reduced.

Although the number of leaf type springs 14 in the present embodiment is four, there may be as few as two in order to obtain the aforesaid effect.

It will thus be seen that the vibrating unit of the apparatus, in this embodiment the print mechanism unit, is suspended from the base by at least two leaf type springs.

Therefore, support in the up and down directions is stable, but spring constant in the right and left directions only is low, and the vibration of the print mechanism unit having a print head moving means which is the main source of vibration can be effectively absorbed or damped.

Thus, particularly in a shuttle dot printer, only a small amount of vibration is transferred from the vibrating unit of the apparatus, here the print mechanism unit, to the housing.

Preferably a locking means is provided for automatically locking the print mechanism unit 2 against swinging movement in the left and right directions when the overall apparatus is lifted from the supporting surface.

Figure 4:
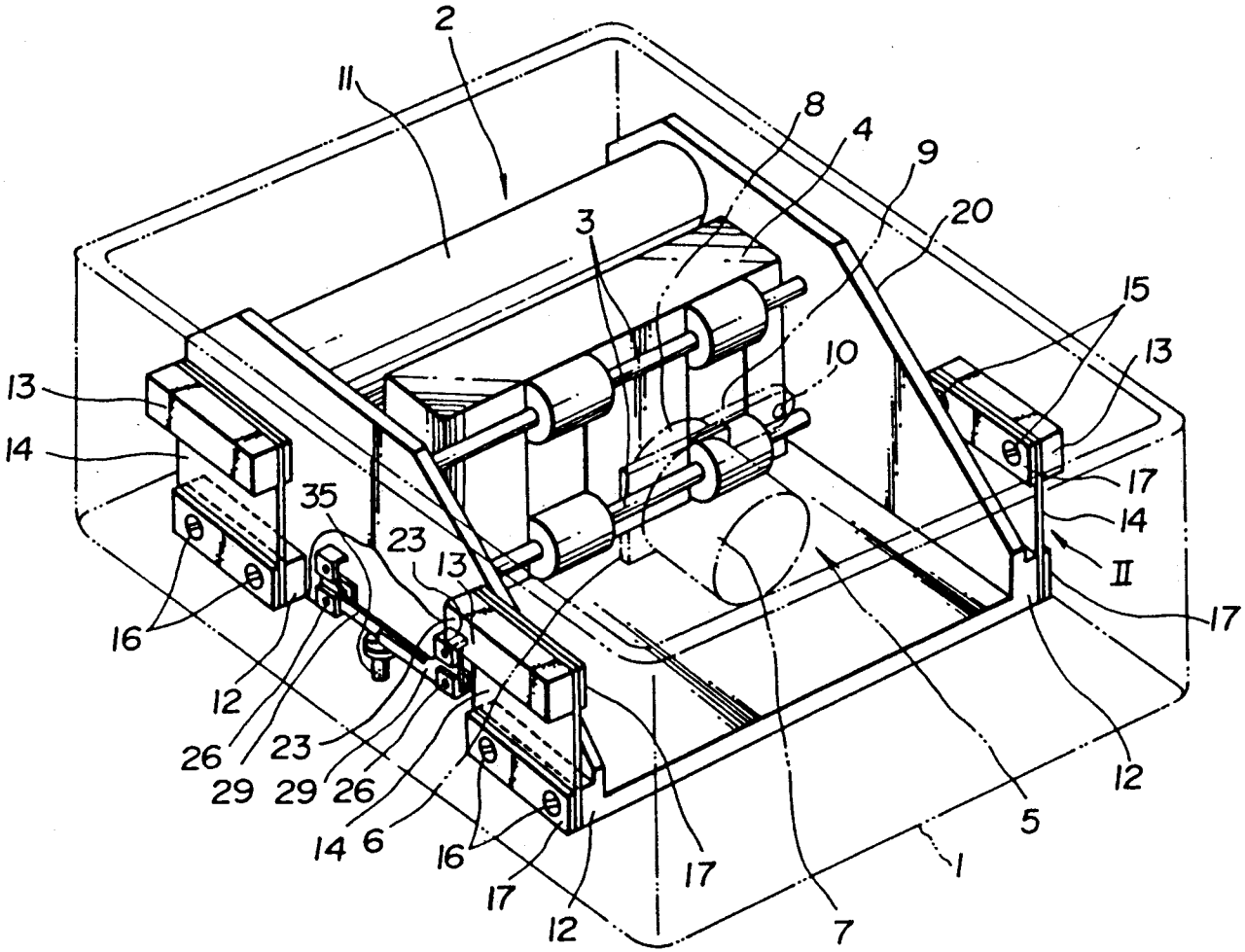
FIG. 4 is a perspective view of the apparatus, with some parts in phantom lines, showing the improved locking means.
Figure 7:
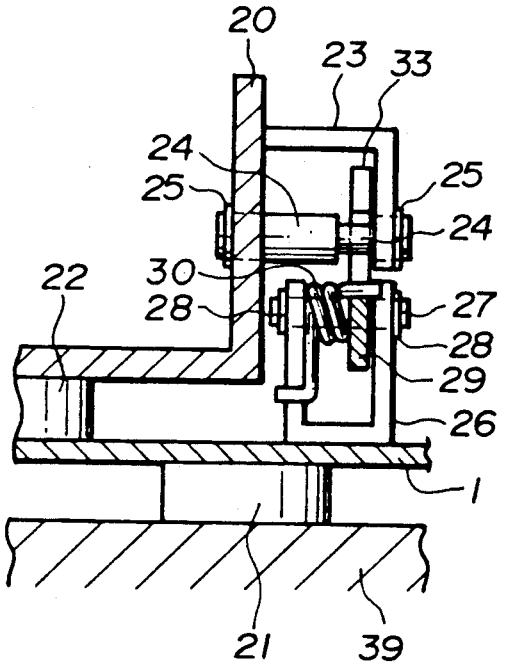
FIG. 7 is a sectional view taken along section lines 7—7 of FIG. 5.
Figure 8:
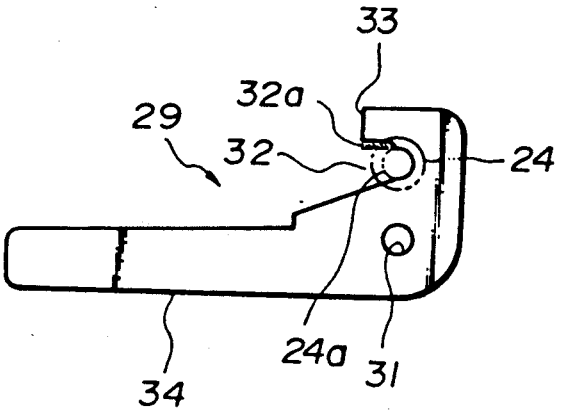
FIG. 8 is an elevation view of a part of the apparatus of FIG. 7.

The locking means comprises a pair of inverted L-shaped brackets 23 mounted on each side of the frame 20 (only the locking means on the left side of the frame 20 is visible in FIG. 4) at points spaced along the frame. Between the frame 20 and each bracket 23 is supported a locking member 24 as shown in FIG. 7. A stopper ring 25 is provided at each end of the member 24 for preventing dislocation of the locking member 24 relative to the frame 20 and the downwardly extending arm of bracket 23. The locking member 24 has a reduced diameter portion **24*a*** in the middle of the length thereof.

A bracket 26 is mounted on the inside surface of the bottom of housing 1 below each bracket 23 on the frame 20. This bracket 26 is U-shaped and has a shaft 27 rotatably mounted therein parallel to locking member 24. Both ends of the rotating shaft 27 have a stopper ring 28 thereon for preventing dislocation of the rotating shaft 27 relative to the bracket 23.

The lock arm 29 is an L-shaped arm and has a C-shaped portion 33 above the shaft 27 with a recess 32 opening toward the length of arm 29. The opening of the recess 32 is a semi-circular opening corresponding to the diameter of the reduced diameter portion **24*a* of the locking member 24. The lock arm 29 is supported on the bracket 26 for engaging of the reduced diameter portion 24*a* in the recess 32. Just inside the tip of the recess 32 is a concave portion 32*a***.

Engagement of the concave portion **32*a* in the C-shaped portion 33 from the reduced diameter portion 24*a* is released by rotation of arm 29 (clockwise in FIG. 7) to raise the arm portion 34**.

The rotating shaft 27 has a coil-type locking spring 30 therearound, and a lock arm 29 has a hole 31 therein by which it is mounted on shaft 27, as shown in FIGS. 4–8. One end of each spring 30 is hooked over the lock arm 29 urging it to rotate toward the base of the casing 1 so as to move the C-shaped portion 33 and recess 32 thereon into locking engagement with locking member 24, and the other end is hooked to the corresponding bracket 26.

The two locking arms 29 on each side of frame 20 have the arm portions 34 extending toward each other with the free ends overlapping.

Beneath the overlapping free end portions is a pressing member 35. The pressing member 35 is a pin-shaped member which has a head 36 with a hemispherical upper surface engaged by the overlapping portions 34, and a shaft 37 extending downwardly from the head 36 which is slidable through a sleeve 38 in the bottom of the casing 1. The shaft 37 of the pressing member 35 extends through the base of housing 1 and the free end projects downwardly from the bottom of the housing 1.

A locking mechanism is provided on both sides of the frame 20.

Figure 5:
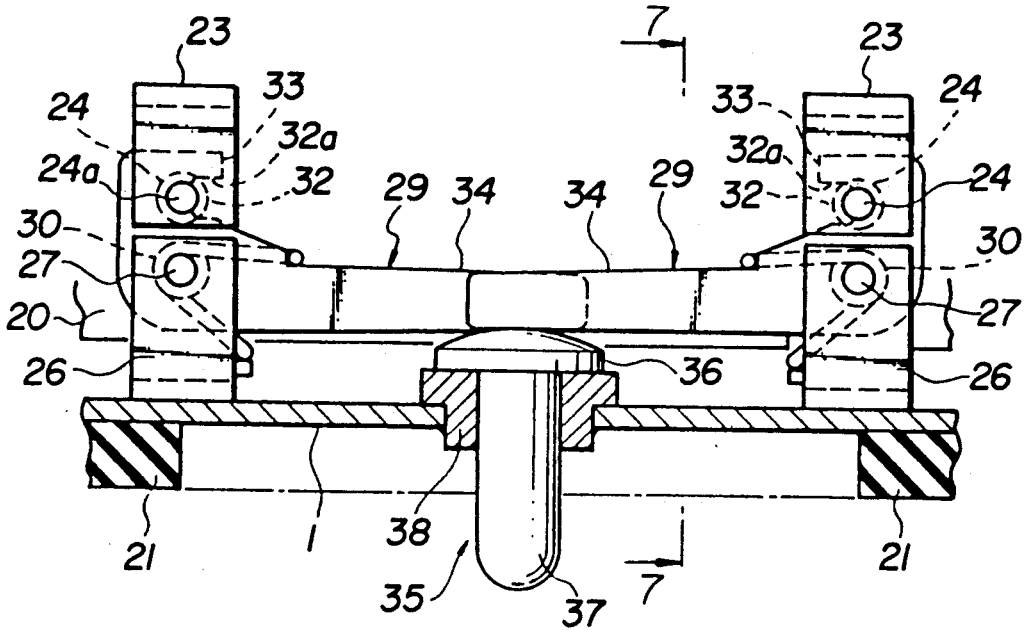
FIG. 5 is a sectional elevation view of the locking means with the locking means shown in the locked position.
Figure 6:
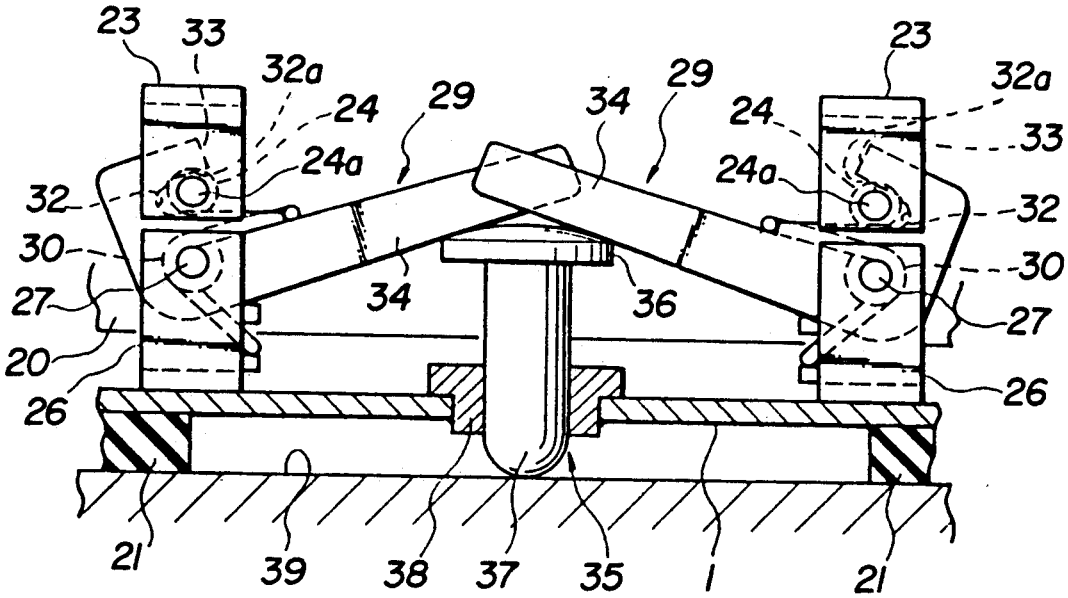
FIG. 6 is a view similar to FIG. 5 showing the parts in the unlocked position.

With the locking mechanism in the condition of FIG. 6, i.e. with the pressing member 35 in the raised position and arm portions 34 urged upwardly to pivot the C-shaped portions 33 out of engagement with the locking members 24, so that the vibrating portion 2 of the apparatus is free to move on the suspending leaf type springs 14, when the casing 1 is lifted from a supporting surface 39 for transporting the apparatus, the pressing member 35 is no longer supported by the surface 39 and is urged downwardly by the spring force of the locking springs 30 through the lock arms 29. Therefore, each lock arm 29 pivots on the shaft 27 under the action of the spring force of the corresponding locking spring. As a result, the apparatus moves to the condition as shown in FIG. 5, with each concave portion **32*a* in the corresponding C-shaped portion 33 engaging with the reduced diameter portion 24*a* of the locking member 24. By this engagement of the lock arms 29 with the locking members 24, the vibrating unit of the apparatus, here the print mechanism unit 2, is locked to the housing 1**.

Therefore, even if the overall apparatus is subjected to a mechanical shock, such as vibration or an impact, during transporting, the print mechanism unit will not be damaged.

When the apparatus is again set on a supporting surface, such as a desk or floor, the parts return to the condition as shown in FIG. 6. The pressing member 35 is pressed upward by being engaged with the supporting surface 39. This force presses the lock arms 29 upward against the force of the springs 30. Each lock arm 29 rotates on the corresponding shaft 27. Each C-shaped portion 33 is released from the reduced diameter portion **24*a* of the corresponding locking member 24, whereby the print mechanism unit 2 is freed from the housing 1. The print mechanism unit 2 is again supported on the housing 1 through the springs 14**, and the vibration damping effect is achieved.

The locking mechanism can be used on similar apparatus which does not include the special vibration damping spring mounting as described in connection with FIGS. 1–3.

Figure 9:
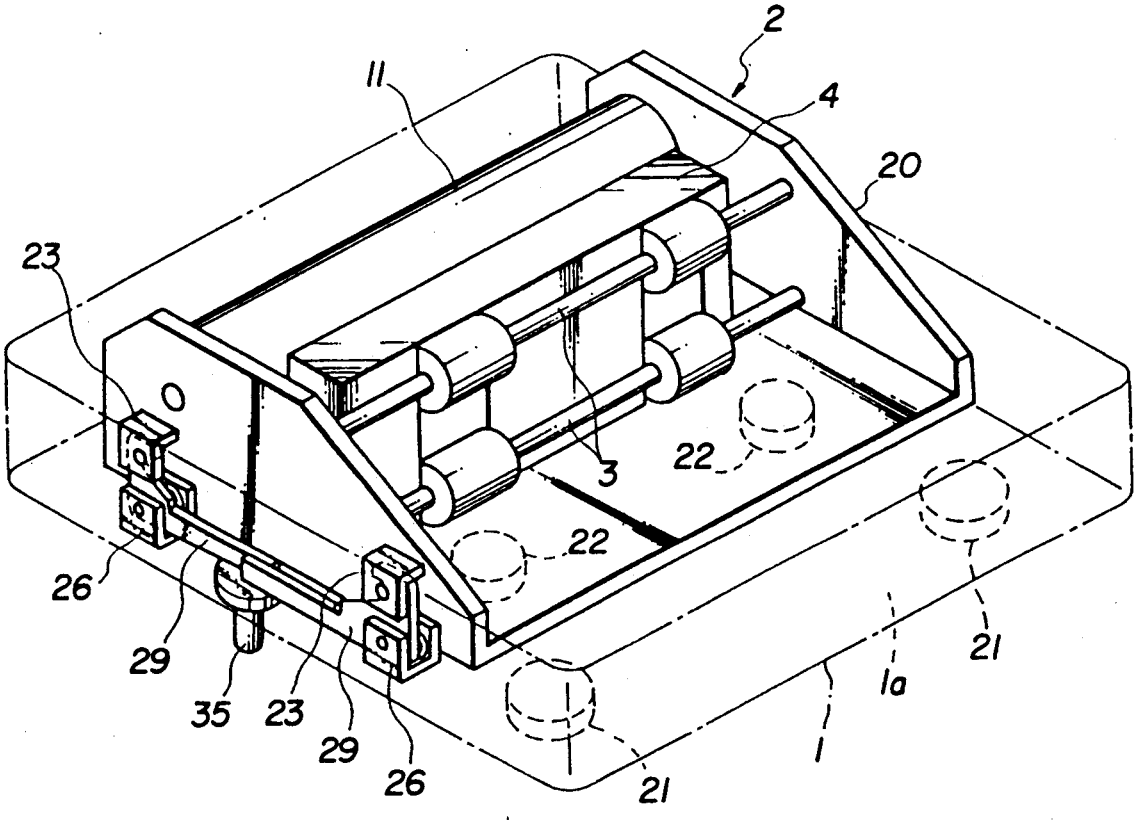
FIG. 9 is a view of a similar printer having only the locking means as an improvement.

As shown in FIG. 9, the overall apparatus can have the vibrating unit, here the print mechanism unit 2, mounted on four feet 22 of vibration absorbing material, such as rubber, and the locking means as described in connection with FIGS. 4–8 can be provided on the sides of the frame 20 for the print mechanism unit 2.

Thus, the locking mechanism operates to automatically lock the vibrating unit of the apparatus when the overall apparatus is lifted from the supporting surface, and further operates to automatically free the vibrating unit when the overall apparatus is again placed on a supporting surface.

What is claimed is:

1. A vibrating printing apparatus comprising:

a casing for said apparatus;

a frame movably mounted in said casing and having opposite lateral end walls;

a printing vibrating unit mounted on said frame, including a printing head and operable to move recroprocatively in directions toward said lateral end walls for generating vibrations which move said frame;

a locking means for locking said frame in position relative to said casing, said locking means having a locking member on said frame, a lock arm pivotally mounted on said casing and pivotable into and out of locking engagement with the locking member, spring means engaged with said lock arm urging said lock arm into locking engagement with the locking member, said lock arm having an arm portion extending therefrom with a free end; and a pressing member extending through said casing and having the end thereof within said casing in engagement with the free end of the lock arm and having the other end projecting out of the casing a distance sufficient for, when the casing is placed on a supporting surface, the frame is freed from said casing by said lock arm being urged out of locking engagement with said locking member by means of pivoting rotation of the lock arm, whereby when the casing is lifted off the supporting surface, the frame is fixed to the casing by the spring means urging said lock arm into locking engagement with said locking member.

2. A vibrating printing apparatus as claimed in claim 1 in which said pressing member is a pin-shaped member and said casing has a sleeve thereon through which said pin-shaped member slidably extends.

3. A vibrating printing apparatus as claimed in claim 1 in which said locking member is a shaft shaped member extending laterally from said vibrating printing unit and having a reduced cross-sectional portion, and said lock arm has a C-shaped portion thereon with a recess therein with a concave portion in said recess positioned tap, when said lock arm is pivoted to the locking arrangement position, engaging said reduced cross-sectional portion.

4. A vibrating printing apparatus as claimed in claim 1 in which said casing has a bracket thereon and a shaft on said bracket on which the corresponding lock arm is pivoted, and said spring means is a coil spring around said shaft with one end engaged with said lock arm and the other end engaged with said bracket.

5. A vibrating printing apparatus as claimed in claim 1 in which said locking means has a pair of locking members, lock arms and spring means and spaced from each other, the arm portions of said lock arms extending toward each other and both being in contact with said pressing member.

6. A vibrating printing apparatus as claimed in claim 5 in which said locking means has said pair of locking members, lock arms and spring means on each lateral end of said vibrating printing unit.

* * * * *